US009062509B2

(12) United States Patent
Sun et al.

(10) Patent No.: US 9,062,509 B2
(45) Date of Patent: Jun. 23, 2015

(54) FORCED COOLING CIRCULATION SYSTEM FOR DRILLING MUD

(75) Inventors: Youhong Sun, Changchun (CN); Jiangpeng Zhao, Changchun (CN); Wei Guo, Changchun (CN); Huiwen Xu, Changchun (CN); Qinghua Wang, Changchun (CN); Chen Chen, Changchun (CN); Guosheng Li, Changchun (CN); Rui Jia, Changchun (CN); Jianguo Zhao, Changchun (CN); Jun Xue, Changchun (CN)

(73) Assignee: JILIN UNIVERSITY, Changchun, Jilin (CN)

( * ) Notice: Subject to any disclaimer, the term of this patent is extended or adjusted under 35 U.S.C. 154(b) by 389 days.

(21) Appl. No.: 13/575,941

(22) PCT Filed: Apr. 15, 2010

(86) PCT No.: PCT/CN2010/071788
§ 371 (c)(1),
(2), (4) Date: Jul. 27, 2012

(87) PCT Pub. No.: WO2011/091626
PCT Pub. Date: Aug. 4, 2011

(65) Prior Publication Data

US 2012/0297801 A1 Nov. 29, 2012

(30) Foreign Application Priority Data

Jan. 28, 2010 (CN) ..... 2010 1 0101730

(51) Int. Cl.
*E21B 36/00* (2006.01)
*E21B 21/01* (2006.01)

(Continued)

(52) U.S. Cl.
CPC ..... *E21B 36/001* (2013.01); *F25D 29/00* (2013.01); *F25D 17/02* (2013.01); *E21B 21/01* (2013.01)

(58) Field of Classification Search
CPC ..... E21B 36/001; E21B 21/01; F25D 29/00; F25D 2700/00; F25D 17/02; F25B 2700/00; F25B 2600/13
USPC ..... 62/185, 201, 126, 129; 175/17; 166/57; 165/154
See application file for complete search history.

(56) References Cited

U.S. PATENT DOCUMENTS 1,881,176 A * 10/1932 Epley ..... 175/17
2,105,091 A * 1/1938 MacKay ..... 175/95

(Continued)

FOREIGN PATENT DOCUMENTS

CN 101066010 A 10/2007
DE 3502527 A1 7/1986

(Continued)

OTHER PUBLICATIONS

PCT International Search Report for PCT/CN2010/071788 dated Oct. 28, 2010.

*Primary Examiner* — Cassey D Bauer
*Assistant Examiner* — Kun Kai Ma
(74) *Attorney, Agent, or Firm* — Nixon Peabody LLP; Joseph Bach, Esq.

(57) ABSTRACT

A forced cooling circulation system for drilling mud, which includes a refrigeration unit (1), a secondary refrigerant tank (4), a coaxial convection heat exchanger (12) for mud and a mud pond (17), is disclosed. The refrigeration unit (1) is in connection with the secondary refrigerant tank (4) and the coaxial convection heat exchanger (12) for mud via a pump (2), and the coaxial convection heat exchanger (12) for mud is in connection with the mud pond (17) via a pump (15) and pipelines. Heat exchange tubes of the coaxial convection heat exchanger (12) for mud are disposed as a double-layer structure or a multi-layer structure, and the inner heat exchange tubes (23) are mounted inside of the outer heat exchange tubes (25). The secondary refrigerant or the mud is circulated in the annular space between the inner heat exchange tubes (23) and the outer heat exchange tubes (25), and the mud or the secondary refrigerant is circulated in the inner tubes (23). The flow of the circulated mud is opposite to that of the circulated secondary refrigerant, and insulation material (24) is painted on the external wall of the outer tubes (25).

7 Claims, 2 Drawing Sheets

(51) Int. Cl.

| | |
|---|---|
| *F25D 29/00* | (2006.01) |
| *F25D 17/02* | (2006.01) |

(56) References Cited

U.S. PATENT DOCUMENTS

| | | | | | |
|---|---|---|---|---|---|
| 2,169,387 | A | * | 8/1939 | Hann | 62/386 |
| 2,289,687 | A | * | 7/1942 | Stuart | 324/324 |
| 2,299,188 | A | * | 10/1942 | Stork et al. | 62/99 |
| 2,961,840 | A | * | 11/1960 | Goldtrap | 62/47.1 |
| 3,118,052 | A | * | 1/1964 | Lippart et al. | 219/137 R |
| 3,172,487 | A | * | 3/1965 | Klotz | 175/17 |
| 3,831,082 | A | * | 8/1974 | Mazzagatti | 324/333 |
| 4,215,753 | A | * | 8/1980 | Champness | 175/17 |
| 4,290,305 | A | * | 9/1981 | Gibson et al. | 73/152.19 |
| 4,483,399 | A | * | 11/1984 | Colgate | 166/308.1 |
| 5,422,143 | A | * | 6/1995 | Yiu | 427/397.8 |
| 5,457,138 | A | * | 10/1995 | Yuge et al. | 521/125 |
| 5,600,960 | A | * | 2/1997 | Schwedler et al. | 62/99 |
| 5,715,895 | A | * | 2/1998 | Champness et al. | 175/17 |
| 6,148,634 | A | * | 11/2000 | Sherwood | 62/434 |
| 6,176,323 | B1 | * | 1/2001 | Weirich et al. | 175/40 |
| 6,186,181 | B1 | * | 2/2001 | Schippl | 138/112 |
| 6,427,462 | B1 | * | 8/2002 | Suenaga et al. | 62/185 |
| 6,866,092 | B1 | * | 3/2005 | Molivadas | 165/104.21 |
| 2001/0037652 | A1 | * | 11/2001 | Sasayama et al. | 62/201 |
| 2002/0163182 | A1 | * | 11/2002 | Kirkegaard | 285/47 |
| 2005/0016201 | A1 | * | 1/2005 | Ivanov et al. | 62/434 |
| 2005/0262869 | A1 | * | 12/2005 | Tongu et al. | 62/434 |
| 2005/0269131 | A1 | * | 12/2005 | Streicher et al. | 175/17 |
| 2006/0144619 | A1 | * | 7/2006 | Storm et al. | 175/17 |
| 2008/0307806 | A1 | * | 12/2008 | Campbell et al. | 62/121 |
| 2009/0032304 | A1 | * | 2/2009 | Groh | 175/48 |
| 2010/0243329 | A1 | * | 9/2010 | Dye et al. | 175/65 |
| 2011/0000572 | A1 | * | 1/2011 | Ramaswamy et al. | 138/149 |

FOREIGN PATENT DOCUMENTS

| | | | | |
|---|---|---|---|---|
| GB | 394740 | A | * | 7/1933 |
| GB | 2116688 | A | * | 9/1983 |
| GB | 2396203 | A | | 6/2004 |
| WO | WO 99/27228 | A1 | | 6/1999 |

* cited by examiner

FORCED COOLING CIRCULATION SYSTEM FOR DRILLING MUD

CROSS-REFERENCE TO RELATED APPLICATIONS

This application is a National Phase of International Application No. PCT/CN2010/071788, which was filed on Apr. 15, 2010, and which claims priority to and the benefit of Chinese Patent Application No. 201010101730.2, filed on Jan. 28, 2010, and the disclosures of which are hereby incorporated herein by reference in their entireties.

TECHNICAL FIELD

The present invention relates to a forced cooling system for circulating medium during drilling, in particular to a forced cooling circulation system for low temperature mud sampled in natural gas hydrate drilling, the system being also configured as a forced cooling circulation system for high temperature mud obtained in petroleum and natural gas drilling, continental scientific deep drilling, and geothermal well deep drilling.

BACKGROUND ART

Exploitation of natural gas hydrates involves, first, obtaining a core sample of natural gas hydrates by drilling and sampling, analyzing the core sample, and assessing hydrogeological parameters such as storage of the natural gas hydrates, and occurrence, scale and property of ore beds of the natural gas hydrate. Thus, drilling and sampling are the most direct measures for exploitation of natural gas hydrates. Natural gas hydrates exists in sedimentary strata with the temperature thereof is 0 to 10° C. and the pressure thereof is higher than 10 MPa, and the natural gas hydrates dissociates in the condition that the temperature of the strata containing the natural gas hydrates increase or that the pressure of the strata decrease. Substantial heat is generated by a drill bit. In this way cutting rocks during drilling and sampling construction, and heat is generated by friction of a drilling tool and a wall of a drilling hole, both of which cause the temperature at the bottom of the hole to increase. The temperature of drilling mud increases as the heat is transferred to the mud. The increasing of the mud temperature will lead to the natural gas hydrates to dissociate during drilling the core of the natural gas hydrates, which makes it possible that no in-situ hi-fi core sample of the natural gas hydrates be obtained. This may not only affects the assessment of the storage of ore bed, but also cause accidents in the drilling hole and damage drilling equipments used. Consequently, the temperature of low temperature mud used for drilling must be controlled and should be generally maintained in the range of −3° C. to 3° C., in order to ensure the stability of the natural gas hydrate stratum and core during drilling.

At present, techniques for cooling mud have been developed. The ground temperature is up to 350° C. and the temperature of the returned mud is up to 60 to 111° C. during drilling in hot water layer of deep geothermal well. The highest ground temperature in WD-1A well in Kakkonda, Japan is up to 500° C., and the mud with high temperature causes severe corrosions to drilling tools and tubes and scalds operation staff easily. Lengthening circulating path of mud channels is generally adopted for cooling the mud, so that the returned mud can be cooled down naturally during the circulation. Another method adopted is adding ice to a mud pond to lower the mud temperature, and mud cooling devices can be deployed if necessary. The designed mud cooling devices include: a cooling tower mounted to the mud pond, and a power fan mounted near a vibrating screen for forced cooling. However, all the above techniques are for high temperature mud, and they are not suitable for cooling low temperature mud sampled during natural gas hydrates drilling, the mud temperature of which should be controlled within the range of −3° C. to 3° C.

SUMMARY OF THE INVENTION

An object of the invention is to overcome the drawbacks existed in the prior art and provides a forced cooling circulation system for drilling mud which is configured for continental frozen soil layer drilling construction and ocean drilling construction, and particularly configured for cooling natural gas hydrates drilling mud obtained in natural gas hydrates drilling and sampling construction, the system also being suitable for cooling the high temperature mud obtained in geothermal well deep drilling, continental scientific deep drilling, and petroleum and natural gas deep drilling.

The above object of the invention is achieved by the technical solutions disclosed below.

In a forced cooling circulation system for drilling mud, an output end of the refrigeration unit is in connection with an input end of the refrigerant tank via a first valve, an output end of the refrigerant tank is in connection with an input end of the refrigeration unit via a third valve and a refrigeration unit pump, another output end of the refrigerant tank is in connection with an input end of the coaxial convection heat exchanger via a first temperature sensor, a fourth valve, a refrigerant tank pump and a second temperature sensor, an output end of the coaxial convection heat exchanger is in connection with the mud pond via a fourth temperature sensor, another input end of the refrigerant tank is in connection with another output end of the coaxial convection heat exchanger via a second valve and a third temperature sensor, and another input end of the coaxial convection heat exchanger is in connection with the mud pond via a fifth temperature sensor and a mud delivery pump; wherein a sixth temperature sensor is provided in the mud pond, a seventh temperature sensor is in connection with an output end of a mud pump extending to the mud pond, and an eighth temperature sensor is provided in a mud circulation channel from an output end of the mud pump returning to the ground, and wherein the first temperature sensor, the second temperature sensor, the third temperature sensor, the fourth temperature sensor, the fifth temperature sensor, the sixth temperature sensor, the eighth temperature sensor and the seventh temperature sensor are in connection in parallel to an inspection instrument, and the inspection instrument is configured for displaying temperature values at all measuring points of the temperature sensors so that parameters related to the system can be adjusted based on the temperature values.

Heat exchange tubes of the coaxial convection heat exchanger are disposed in a two-layer configuration or in a multiple-layer configuration, in which an inner tube is fitted within an outer tube, the inner tube is coaxial with the outer tube, and an annular gap formed between these two tubes is configured as a circulation passage for refrigerant or mud, the annular gap being closed at two ends thereof; the inner tube is configured as a circulation passage for mud or refrigerant, the circulating mud and refrigerant flowing conversely so as to form counter flow heat exchange; the inner tubes are communicated with each other via flanges and U-shaped bellows, the outer tubes are communicated with each other via short tubes and flanges, there are also flanges provided between the short tubes, and a support is welded to the outer tubes to define a distance between two outer tubes; a mud or refrigerant inlet and a mud or refrigerant outlet are provided on the same end of the mud convection heat exchanger, a refrigerant or mud inlet and a refrigerant or mud outlet are provided on the same side of the coaxial convection heat exchanger and communicated with the outer tubes, and an outer wall of the outer tubes is coated with a thermal insulation layer.

The thermal insulation layer comprises a four-layer structure composed of, from inside to outside, a layer of thermal insulation paint, polyurethane foams, a rigid thermal insulation material and a tinfoil in sequence. The thermal insulation paint is configured as an oil-based double-component thermal insulation primer, a layer of thermal insulation paint for oil tank or a layer of aqueous thermal insulation paint. The rigid thermal insulation material is preferably configured as a rigid rubber or a rigid polyurethane foam tile. The inner tube has a smooth surface as an inner wall, and the refrigerant is aqueous glycol solution or other low temperature resistant materials.

Benefits of the invention are embodied in the following aspects: the forced cooling circulation system for drilling mud, upon test, has a good heat exchange effect, can be able to cool mud quickly, can dynamically maintain the temperature of the mud within defined temperature range, and operate simply.

REFERENCE LISTS

Figure 1:
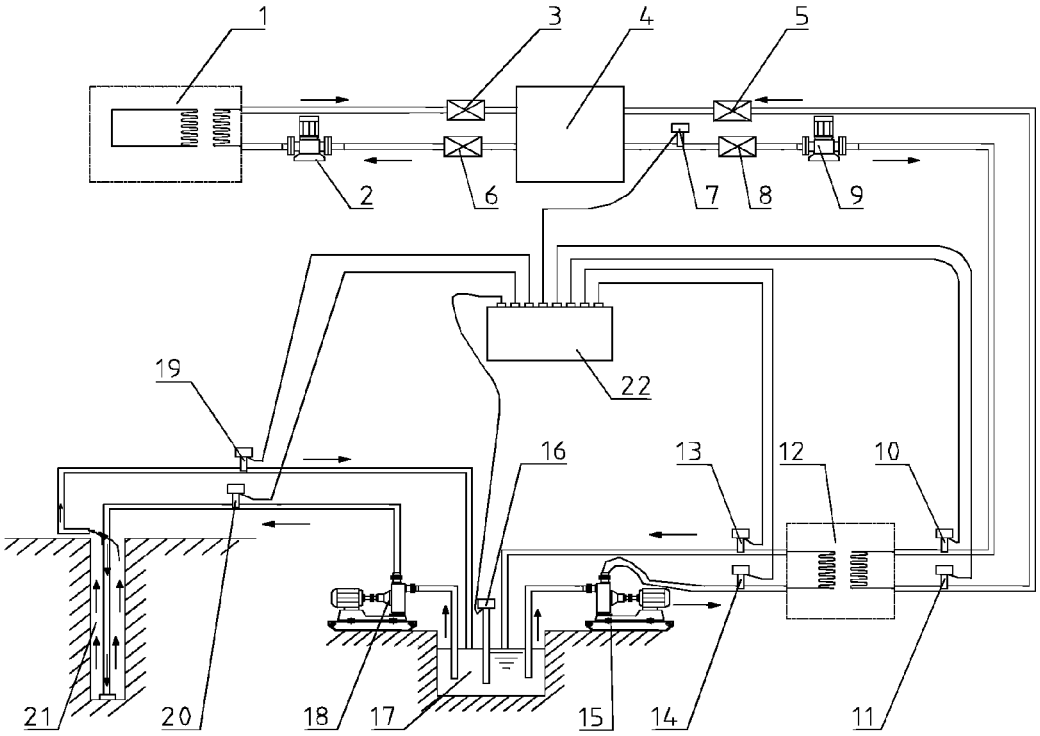
FIG. 1 is a structural illustration of a forced cooling circulation system for drilling mud.
Figure 2:
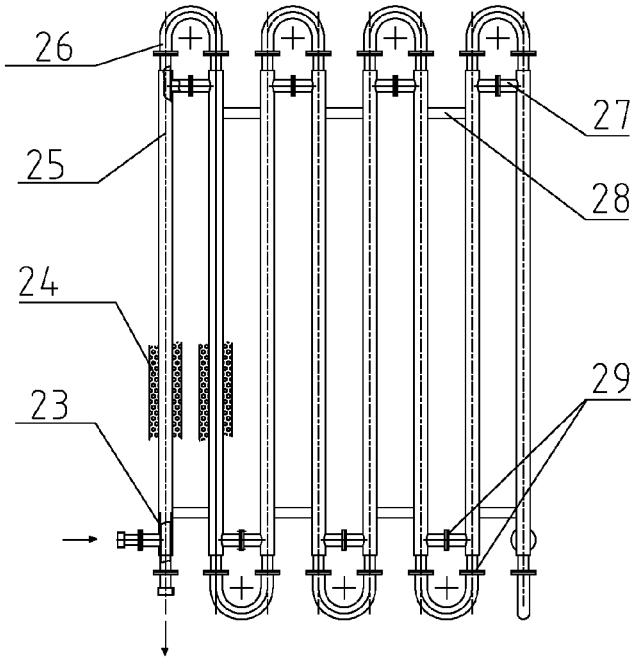
FIG. 2 is a top view of a coaxial convection heat exchanger 12 of FIG. 1.
Figure 3:
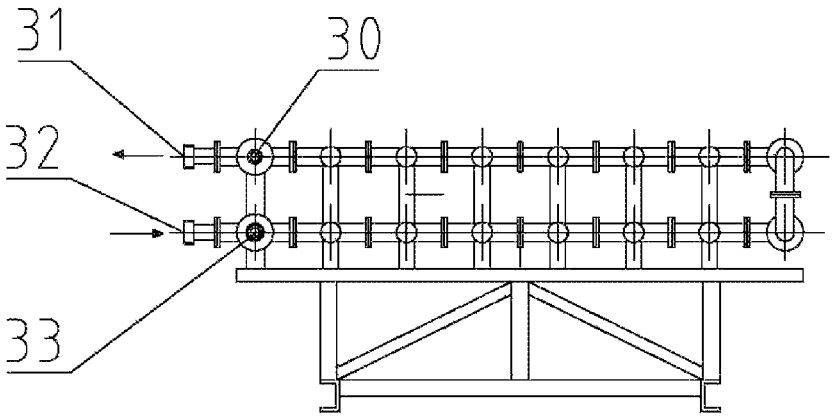
FIG. 3 is a front view of the coaxial convection heat exchanger 12 of FIG. 1.
Figure 4:
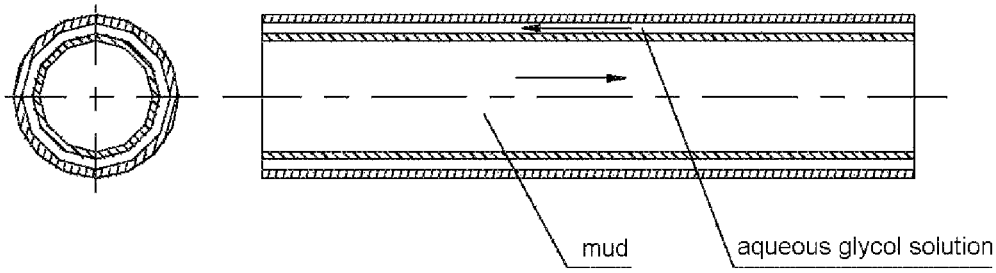
FIG. 4 is a structural illustration of heat exchange tubes of the coaxial convection heat exchanger 12 of FIG. 1.
Figure 5:
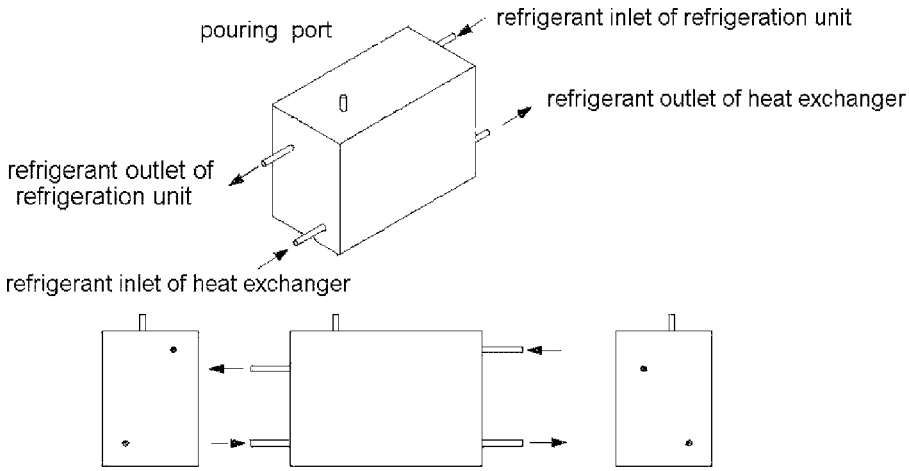
FIG. 5 shows layout of ports of tubes of a refrigerant tank 4 of FIG. 1.

1 refrigeration unit, 2 refrigeration unit pump, 3 first valve, 4 refrigerant tank, 5 second valve, 6 third valve, 7 first temperature sensor, 8 fourth valve, 9 refrigerant tank pump, 10 second temperature sensor, 11 third temperature sensor, 12 coaxial convection heat exchanger, 13 sixth temperature sensor, 14 fifth temperature sensor, 15 mud delivery pump, 16 sixth temperature sensor, 17 mud pond, 18 mud pump, 19 eighth temperature sensor, 20 seventh temperature sensor, 21 drilling hole, 22 inspection instrument, 23 inner tube, 24 insulation layer, 25 outer tube, 26 U-shaped bellow, 27 short tube, 28 support, 29 flange, 30 mud inlet or refrigerant inlet, 31 refrigerant outlet or mud outlet, 32 refrigerant inlet or mud inlet, 33 mud outlet or refrigerant outlet.

DETAILED DESCRIPTION OF PREFERRED EMBODIMENTS

A further detail description to the invention will be given now in combination with the drawings and examples.

Example 1

A forced cooling circulation system for drilling mud is provided, in which an output end of its refrigeration unit 1 is connected with a refrigerant tank 4 via a first valve 3, an output end of the refrigerant tank 4 is connected with an input end of the refrigeration unit 1 via a third valve 6 and a refrigeration unit pump 2, another output end of the refrigerant tank 4 is connected with an input end of a coaxial convection heat exchanger 12, In this way a refrigerant inlet 32, via a first temperature sensor 7, a fourth valve 8, a refrigerant tank pump 9 and a second temperature sensor 10, an output end of the coaxial convection heat exchanger 12, In this way a mud outlet 33, is connected with a mud pond 17 via a fourth temperature sensor 13, an input end of the refrigerant tank 4 is connected with another output end of the coaxial convection heat exchanger 12, In this way a refrigerant outlet 31, via a second valve 5 and a third temperature sensor 11, and an input end of the coaxial convection heat exchanger 12, In this way a mud inlet 32, is connected with the mud pond 17 via a fifth temperature sensor 14 and a mud delivery pump 15. A sixth temperature sensor 16 is provided in the mud pond 17, a seventh temperature sensor 20 is connected with an output end of a mud pump 18 extending to the mud pond, and an eighth temperature sensor 19 is provided in a mud channel returning back to the ground. The first temperature sensor 7, the second temperature sensor 10, the third temperature sensor 11, the fourth temperature sensor 13, the fifth temperature sensor 14, the sixth temperature sensor 16, the eighth temperature sensor 19 and the seventh temperature sensor 20 are in a parallel connection to an inspection instrument 22. The inspection instrument is configured for displaying temperature values at all measuring points of the temperature sensors, so that parameters related to the system can be adjusted based on the temperature values.

The coaxial convection heat exchanger is disposed in a double-layer configuration, in which an inner tube 23 and an outer tube 25 are straight segments with the same length. The inner tube 23 is fitted within the outer tube 25 and the inner tube 23 is coaxial with the outer tube 25, constituting a set of coaxial tubes. The coaxial tubes in different sets are arranged in parallel, and the inner tubes 23 of the coaxial tubes in adjacent two sets are communicated with each other via a U-shaped bellow 26 and a flange 29. An annular gap is formed by the outer tube 25 and the inner tube 23, and the annular gap of the coaxial tubes in each set is closed at two ends thereof. A short tube 27 is welded to the outer tube 25 at one side of the outer tube 25 and is communicated with a short tube 27 which is welded to the outer tube 25 of the coaxial tubes in a neighboring set via a further flange 29. The coaxial tubes in these two sets are connected with each other at the other end by means of a support 28. The support 28 and the short tube 27 have the same length. The support 28 defines a distance of the outer tubes 25 in the adjacent two sets to keep the outer tubes 25 parallel. An outer surface of the outer tubes 25, an outer surface of the short tube 27 connecting the outer tubes 25, and an outer surface of the U-shaped bellow 26 are each coated with an insulation layer 24. The insulation layer 24 has an innermost layer which is formed as an oil-based double-component thermal insulation primer applied onto the outer tubes 25, and, from inside to outside, polyurethane foams, a rigid rubber and a tinfoil are wrapped in sequence. The mud inlet 30 and the mud outlet 33 are provided at a first side of the same end of the coaxial tubes in two layers respectively, and the refrigerant inlet 32 and the refrigerant outlet 31 are provided at a second side of the same end of the coaxial tubes in two layers respectively, the second side being different from the first side. The mud inlet and the refrigerant outlet are located at two neighboring sides of the coaxial tubes in one layer, and the mud outlet and the refrigerant inlet are located at two neighboring sides of the coaxial tubes in the other layer. The circulating medium in the inner tube 23 is mud, and the circulating medium flowing in the annular gap formed by the outer tube 25 and the inner tube 23 is refrigerant, these two media flowing conversely so as to form counter flow heat exchange. All heat exchange tubes are connected together and fixed to a chassis which is configured as a steel structure, and transported to a construction site when required. The mud in the mud pond 17 is delivered into the coaxial convection heat exchanger 12 via a mud delivery pump 15, and returned to the mud pond 17 after cooled. In this way, the mud in the mud pond 17 is cooled at the coaxial convection heat exchanger 12 by continuously circulating, and the cooled mud is delivered into a drilled hole 21 via a mud pump 18 in a drill.

A working process of the forced cooling circulation system for drilling mud is as follows: the refrigerant in the refrigerant tank 4 is delivered into the refrigeration unit 1 via the third valve 6 and the refrigeration unit pump 2, is returned to the refrigerant tank 4 via the output end of the refrigeration unit 1 and the first valve 3 after cooled by the refrigeration unit 1, and is then delivered to the coaxial convection heat exchanger 12 via the first temperature sensor 7, the second valve 8, the refrigerant tank pump 9 and the second temperature sensor 10. Then, heat exchanging is performed to the mud in the coaxial convection heat exchanger 12. The heated refrigerant by heat exchanging is returned to the refrigerant tank 4 via the third temperature sensor 11 and the second valve 5 and is mixed with the refrigerant cooled by the refrigeration unit 1, during which heat exchanging occurs. The resulted refrigerant is returned to the refrigeration unit 1 via the third valve 6 and the refrigeration unit pump 2 and is cooled again. The process is repeated. The cooled mud is delivered to the mud pond 17 via the fourth temperature sensor 13, and is delivered to the bottom of the hole via the mud pump 18, the seventh temperature sensor 20, a tap and a drill pipe, so as to lower the temperature of a drill bit and a protection wall. After lowering the temperature of the drill bit and the protection wall, the mud is returned to the ground via an annular gap between the drill pipe and a wall of the hole, and then moved to the mud pond 17 via the eighth temperature sensor 19 and the mud channel. The cuttings carried with the mud deposits in the mud pond 17, and after this, the mud is delivered to the coaxial convection heat exchanger 12 via the mud delivery pump 15 to be cooled by heat exchanging. The resulted mud is delivered to the bottom of the hole via the mud pump 18, the seventh temperature sensor 20, the tap and the drill pipe, so as to lower the temperature of the drill bit and the protection wall. The process is repeated.

During the process of mud cooling by the forced cooling circulation system for drilling mud, the datum detected by the first temperature sensor 7, the second temperature sensor 10, the third temperature sensor 11, the fourth temperature sensor 13, the fifth temperature sensor 14, the sixth temperature sensor 16, the eighth temperature sensor 19 and the seventh temperature sensor 20 are displayed in real-time on a screen of the inspection instrument 22.

Example 2

A forced cooling circulation system for drilling mud is provided, in which an output end of its refrigeration unit 1 is connected with a refrigerant tank 4 via a first valve 3, an output end of the refrigerant tank 4 is connected with an input end of the refrigeration unit 1 via a third valve 6 and a refrigeration unit pump 2, another output end of the refrigerant tank 4 is connected with an input end of a coaxial convection heat exchanger 12, In this way a refrigerant inlet 32, via a first temperature sensor 7, a fourth valve 8, a refrigerant tank pump 9 and a second temperature sensor 10, an output end of the coaxial convection heat exchanger 12, In this way a mud outlet 33, is connected with a mud pond 17 via a fourth temperature sensor 13, an input end of the refrigerant tank 4 is connected with another output end of the coaxial convection heat exchanger 12, In this way a refrigerant outlet 31 via a second valve 5 and a third temperature sensor 11, and an input end of the coaxial convection heat exchanger 12, In this way a mud inlet 32, is connected with a mud pond 17 via a fifth temperature sensor 14 and a mud delivery pump 15. A sixth temperature sensor 16 is provided in the mud pond 17, a seventh temperature sensor 20 is connected with an output end of the mud pump 18 extending to the mud pond, and the eighth temperature sensor 19 is accommodated within a mud channel returning to the ground. The first temperature sensor 7, the second temperature sensor 10, the third temperature sensor 11, the fourth temperature sensor 13, the fifth temperature sensor 14, the sixth temperature sensor 16, the eighth temperature sensor 19 and the seventh temperature sensor 20 are in parallel connection with an inspection instrument 22.

The coaxial convection heat exchanger is disposed in a multiple-layer configuration, in which an inner tube 23 and an outer tube 25 are straight segments with the same length. The inner tube 23 is fitted within the outer tube 25, the inner tube 23 is coaxial with the outer tube 25, and an annular gap is formed by the outer tube 25 and the inner tube 23, constituting a set of coaxial tubes. The annular gap of the coaxial tubes in each set is closed at two ends thereof. Whether the coaxial tubes in different sets are arranged in a planar relationship or in a vertical relationship, the inner tubes 23 of the coaxial tubes in adjacent two sets are communicated with each other via a U-shaped bellow 26 and a flange 29. A short tube 27 is welded to the outer tube 25 at one side of the outer tube 25 and is communicated with the short tube 27 welded to the outer tube 25 of the coaxial tubes in a neighboring set via a further flange 29. The coaxial tubes in adjacent two sets are connected with each other at the other end by means of a support 28. The support 28 and the short tube 27 have the same length. The support 28 defines a distance of the outer tubes 25 in the adjacent two sets to keep the outer tubes 25 parallel. An outer surface of the outer tubes 25, an outer surface of the short tube 27 connecting the outer tubes 25, and an outer surface of the U-shaped bellow 26 are each coated with an insulation layer 24. The insulation layer 24 has an innermost layer which is formed as a layer of thermal insulation paint for oil tank applied onto the outer tubes 25, and, from inside to outside, polyurethane foams, a rigid polyurethane foam tile and a tinfoil are wrapped in sequence. The mud inlet 30 on the coaxial tubes of a third layer and the mud outlet 33 on the coaxial tubes of a second layer are communicated with each other via a U-shaped bellow 26 and a flange 29, the refrigerant outlet 31 on the coaxial tubes of the third layer and the refrigerant inlet 32 on the coaxial tubes of the second layer are communicated with the short tube 27 welded to the outer tube 25 of the third layer via a further flange 29, and the same applies to a fourth layer, a fifth layer till the Nth layer. The refrigerant outlet 31 is welded onto a side of the outer tube 25 of the coaxial tubes of a last layer, and the mud outlet 33 is provided at the same end of the coaxial tubes of the last layer as the refrigerant outlet 31. The mud inlet 30 and the refrigerant outlet 31 are located at two neighboring sides of the coaxial tubes, and the mud outlet 33 and the refrigerant inlet 32 are located at two neighboring sides of the coaxial tubes. The circulating medium in the inner tube 23 is mud, and the circulating medium flowing in the annular gap formed by the outer tube 25 and the inner tube 23 is refrigerant, these two media flowing conversely so as to form counter flow heat exchange. All heat exchange tubes are connected together and fixed to a chassis which is configured as a steel structure, and transported to a construction site when required. The mud in the mud pond 17 is delivered into the coaxial convection heat exchanger 12 via a mud delivery pump 15, and returned to the mud pond 17 after cooled. In this way, the mud in the mud pond is cooled at the coaxial convection heat exchanger 12 by continuously circulating, and the cooled mud is delivered into a drilled hole 21 via a mud pump 18 in a drill.

A working process of the forced cooling circulation system for drilling mud is as follows: the refrigerant in the refrigerant tank 4 is delivered to the refrigeration unit 1 via the third valve 6 and the refrigeration unit pump 2, is returned to the refrigerant tank 4 via the output end of the refrigeration unit 1 and the first valve 3 after cooled by the refrigeration unit 1, and is then delivered to coaxial convection heat exchanger 12 via the first temperature sensor 7, the second valve 8, the refrigerant tank pump 9 and the second temperature sensor 10. Then, heat exchanging is performed to the mud in the coaxial convection heat exchanger 12. The heated refrigerant by heat exchanging is returned to the refrigerant tank 4 via the third temperature sensor 11 and the second valve 5 and is mixed with the refrigerant cooled by the refrigeration unit 1, during which heat exchanging occurs. The resulted refrigerant is returned to the refrigeration unit 1 via the third valve 6 and the refrigeration unit pump 2 and is cooled again. The process is repeated. The cooled mud is delivered to the mud pond 17 via the fourth temperature sensor 13, and is delivered to the bottom of the hole via the mud pump 18, the seventh temperature sensor 20, a tap and a drill pipe, so as to lower the temperature of a drill bit and a protection wall. After lowering the temperature of the drill bit and the protection wall, the mud is returned to the ground via an annular gap between the drill pipe and a wall of the hole, and then moved to the mud pond 17 via the eighth temperature sensor 19 and the mud channel. The cuttings carried with the mud deposits in the mud pond 17, and after this, the mud is then delivered to the coaxial convection heat exchanger 12 via the mud delivery pump 15 to be cooled by heat exchanging. The resulted mud is delivered to the bottom of the hole via the mud pump 18, the seventh temperature sensor 20, the tap and the drill pipe, so as to lower the temperature of the drill bit and the protection wall. The process is repeated.

During the process of mud cooling by the forced cooling circulation system for drilling mud, the datum detected by the first temperature sensor 7, the second temperature sensor 10, the third temperature sensor 11, the fourth temperature sensor 13, the fifth temperature sensor 14, the sixth temperature sensor 16, the eighth temperature sensor 19 and the seventh temperature sensor 20 are real-time displayed on a screen of the inspection instrument 22.

Example 3

A forced cooling circulation system or a drilling mud is provided, in which an output end of its refrigeration unit 1 is connected with a refrigerant tank 4 via a first valve 3, an output end of the refrigerant tank 4 is connected with an input end of the refrigeration unit 1 via a third valve 6 and a refrigeration unit pump 2, another output end of the refrigerant tank 4 is connected with an input end of a coaxial convection heat exchanger 12, In this way a refrigerant inlet 30, via a first temperature sensor 7, a fourth valve 8, a refrigerant tank pump 9 and a second temperature sensor 10, an output end of the coaxial convection heat exchanger 12, In this way a mud outlet 31, is connected with a mud pond 17 via a fourth temperature sensor 13, an input end of the refrigerant tank 4 is connected with another output end of the coaxial convection heat exchanger 12, In this way a refrigerant outlet 33 via a second valve 5 and a third temperature sensor 11, and an input end of the coaxial convection heat exchanger 12, In this way a mud inlet 32, is connected with the mud pond 17 via a fifth temperature sensor 14 and a mud delivery pump 15. A sixth temperature sensor 16 is provided in the mud pond 17, a seventh temperature sensor 20 is connected with an output end of a mud pump 18 which is connected to the mud pond, and an eighth temperature sensor 19 is provided in a mud channel returning to the ground. The first temperature sensor 7, the second temperature sensor 10, the third temperature sensor 11, the fourth temperature sensor 13, the fifth temperature sensor 14, the sixth temperature sensor 16, the eighth temperature sensor 19 and the seventh temperature sensor 20 are in a parallel connection to an inspection instrument 22.

The coaxial convection heat exchanger is configured such that an inner tube 23 and an outer tube 25 are straight segments with the same length. The inner tube 23 is fitted within the outer tube 25 and the inner tube 23 is coaxial with the outer tube 25, constituting a set of coaxial tubes. The coaxial tubes in different sets are arranged in parallel, and the inner tubes 23 of the coaxial tubes in adjacent two sets are communicated with each other via a U-shaped bellow 26 and a flange 29. An annular gap is formed by the outer tube 25 and the inner tube 23, and the annular gap of the coaxial tubes in each set is closed at two ends thereof. A short tube 27 is welded to the outer tube 25 at one side of the outer tube 25 and is communicated with the short tube 27 welded to the outer tube 25 of the coaxial tubes in a neighboring set via a further flange 29. The coaxial tubes in these two sets are connected with each other at the other end by means of a support 28. The support 28 and the short tube 27 have the same length. The support 28 defines a distance of the outer tubes 25 in the adjacent two sets to keep the outer tubes 25 parallel. The refrigerant inlet 30 and the refrigerant outlet 33 are provided at the same first side, and the mud inlet 32 and the mud outlet 31 are provided at the same second side. The refrigerant inlet 30 and the mud outlet 31 are located at two neighboring sides, and the refrigerant outlet 33 and the mud inlet 32 are located at two neighboring sides. The circulating medium in the inner tube 23 is refrigerant, and the circulating medium flowing in the annular gap formed by the outer tube 25 and the inner tube 23 is mud, these two media flowing conversely so as to form counter flow heat exchange. All heat exchange tubes are connected together and fixed to a chassis which is configured as a steel structure, and transported to a construction site when required. The mud in the mud pond 17 is delivered into the coaxial convection heat exchanger 12 via a mud delivery pump 15, and returned to the mud pond 17 after cooled. In this way, the mud in the mud pond 17 is cooled at the coaxial convection heat exchanger 12 by continuously circulating, and the cooled mud is delivered into a drilled hole 21 via a mud pump 18 in a drill.

A working process of the forced cooling circulation system for drilling mud is as follows: the refrigerant in the refrigerant tank 4 is delivered into the refrigeration unit 1 via the third valve 6 and the refrigeration unit pump 2, is returned to the refrigerant tank 4 via the output end of the refrigeration unit 1 and the first valve 3 after cooled by the refrigeration unit 1, and is then delivered to the coaxial convection heat exchanger 12 via the first temperature sensor 7, the second valve 8, the refrigerant tank pump 9 and the second temperature sensor 10. Then, heat exchanging is performed to the mud in the coaxial convection heat exchanger 12. The heated refrigerant by heat exchanging is returned to the refrigerant tank 4 via the third temperature sensor 11 and the second valve 5 and is mixed with the refrigerant cooled by the refrigeration unit 1, during which heat exchanging occurs. The resulted refrigerant is returned to the refrigeration unit 1 via the third valve 6 and the refrigeration unit pump 2 and is cooled again. The process is repeated. The cooled mud is delivered to the mud pond 17 via the fourth temperature sensor 13, and is delivered to the bottom of the hole via the mud pump 18, the seventh temperature sensor 20, a tap and a drill pipe, so as to lower the temperature of a drill bit and a protection wall. After lowering the temperature of the drill bit and the protection wall, the mud is returned to the ground via an annular gap between the drill pipe and a wall of the hole, and then moved to the mud pond 17 via the eighth temperature sensor 19 and the mud channel. The cuttings carried with the mud deposits in the mud pond 17, and after this, the mud is then delivered to the coaxial convection heat exchanger 12 via the mud delivery pump 15 to be cooled by heat exchanging. The resulted mud is delivered to the bottom of the hole via the mud pump 18, the seventh temperature sensor 20, the tap and the drill pipe, so as to lower the temperature of the drill bit and the protection wall. The process is repeated.

During the process of mud cooling by the forced cooling circulation system for the drilling mud, the datum detected by the first temperature sensor 7, the second temperature sensor 10, the third temperature sensor 11, the fourth temperature sensor 13, the fifth temperature sensor 14, the sixth temperature sensor 16, the eighth temperature sensor 19 and the seventh temperature sensor 20 are real-time displayed on a screen of the inspection instrument 22.

The invention claimed is:

1. A forced cooling circulation system for drilling mud comprising a refrigeration unit, a refrigerant tank, a coaxial convection heat exchanger, and a mud pond, wherein an output end of the refrigeration unit is in connection with an input end of the refrigerant tank via a first valve, an output end of the refrigerant tank is in connection with an input end of the refrigeration unit via a third valve and a refrigeration unit pump, another output end of the refrigerant tank is in connection with an input end of the coaxial convection heat exchanger via a first temperature sensor, a fourth valve, a refrigerant tank pump and a second temperature sensor, an output end of the coaxial convection heat exchanger is in connection with the mud pond via a fourth temperature sensor, another input end of the refrigerant tank is in connection with another output end of the coaxial convection heat exchanger via a second valve and a third temperature sensor, and another input end of the coaxial convection heat exchanger is in connection with the mud pond via a fifth temperature sensor and a mud delivery pump, wherein a sixth temperature sensor is provided in the mud pond, a seventh temperature sensor is in connection with an output end of a mud pump extending to the mud pond, and an eighth temperature sensor is provided in a mud circulation channel from an output end of the mud pump returning to the ground, wherein the first temperature sensor, the second temperature sensor, the third temperature sensor, the fourth temperature sensor, the fifth temperature sensor, the sixth temperature sensor, the eighth temperature sensor and the seventh temperature sensor are in connection in parallel to an inspection instrument, and the inspection instrument is configured for displaying temperature values at all measuring points of the temperature sensors so that parameters related to the system can be adjusted based on the temperature values, and wherein heat exchange tubes of the coaxial convection heat exchanger are disposed in a two-layer or multiple-layer configuration, in which an inner tube is fitted within an outer tube, the inner tube the is coaxial with the outer tube, and an annular gap formed between these two tubes is configured as a circulation passage for refrigerant or mud, the annular gap being closed at two ends thereof, wherein the inner tube is configured as a circulation passage for mud or refrigerant, the circulating mud and refrigerant flowing conversely so as to form counter flow heat exchange, wherein the inner tubes are communicated with each other via flanges and U-shaped bellows, the outer tubes are communicated with each other via short tubes welded to sides of the outer tubes and flanges provided between the short tubes, and a support is welded to the outer tubes to define a distance between two neighboring outer tubes, each support having a length equal to the total length of the outer tubes between two neighboring outer tubes, and wherein a mud or refrigerant inlet and a mud or refrigerant outlet are provided on the same end of the mud convection heat exchanger, a refrigerant or mud inlet and a refrigerant or mud outlet are provided on the same side of the coaxial convection heat exchanger and communicated with the outer tubes, and an outer wall of the outer tubes is coated with a thermal insulation layer.

2. The forced cooling circulation system for drilling mud according to claim 1, wherein the thermal insulation layer comprises a four-layer structure composed of, from inside to outside, a layer of thermal insulation paint, polyurethane foams, a rigid thermal insulation material and a tinfoil in sequence.

3. The forced cooling circulation system for drilling mud according to claim 2, wherein the thermal insulation paint is configured as an oil-based double-component thermal insulation primer, a layer of thermal insulation paint for oil tank or a layer of aqueous thermal insulation paint.

4. The forced cooling circulation system for drilling mud according to claim 2, wherein the rigid thermal insulation material is preferably configured as a rigid rubber or a rigid polyurethane foam tile.

5. The forced cooling circulation system for drilling mud according to claim 2, wherein the inner tube has a smooth surface as an inner wall, and the refrigerant is aqueous glycol solution or other low temperature resistant materials.

6. The forced cooling circulation system for drilling mud according to claim 1, wherein rubber hoses configured for the connections are each provided with an outer thermal insulation material which comprises a three-layer structure composed of an insulation paint layer, an asbestos insulation material layer and a tinfoil layer from inside to outside in sequence.

7. The forced cooling circulation system for drilling mud according to claim 1, wherein a casing of the refrigerant tank is provided outside the refrigerant tank with an insulation layer and a protection layer which are composed of, from inside to outside in sequence, polyurethane foams and a thick iron sheet respectively.

* * * * *